US007544051B2

(12) United States Patent
Bootle

(10) Patent No.: US 7,544,051 B2
(45) Date of Patent: Jun. 9, 2009

(54) CAM-DRIVEN FLUID PUMP

(75) Inventor: Geoffrey David Bootle, Maidstone (GB)

(73) Assignee: Delphi Technologies, Inc., Troy, MI (US)

( * ) Notice: Subject to any disclaimer, the term of this patent is extended or adjusted under 35 U.S.C. 154(b) by 571 days.

(21) Appl. No.: 10/780,428

(22) Filed: Feb. 17, 2004

(65) Prior Publication Data

US 2004/0228749 A1 Nov. 18, 2004

(30) Foreign Application Priority Data

Feb. 17, 2003 (GB) ..... 0303603.5

(51) Int. Cl.
*F04B 37/12* (2006.01)
*F04B 7/04* (2006.01)

(52) U.S. Cl. ..... 417/486; 417/462; 417/490; 417/498

(58) Field of Classification Search ..... 417/462, 417/486, 490, 498
See application file for complete search history.

(56) References Cited

U.S. PATENT DOCUMENTS 2,313,302 A * 3/1943 Sobek ..... 417/486
3,267,861 A * 8/1966 Pigeroulet et al. ..... 417/462
4,709,673 A * 12/1987 Babitzka ..... 123/299
5,427,073 A 6/1995 Timms et al.
5,613,839 A * 3/1997 Buckley ..... 417/273
5,884,608 A * 3/1999 Cooke ..... 123/495
6,041,760 A * 3/2000 Fehlmann et al. ..... 123/502
6,240,901 B1 * 6/2001 Jay ..... 123/446

FOREIGN PATENT DOCUMENTS

| | | |
|---|---|---|
| EP | 1219827 | 7/2002 |
| GB | 390668 | 4/1933 |
| GB | 496346 | 11/1938 |
| WO | 02084105 | 10/2002 |

* cited by examiner

*Primary Examiner*—Devon C Kramer
*Assistant Examiner*—Patrick Hamo
(74) *Attorney, Agent, or Firm*—Thomas N. Twomey

(57) ABSTRACT

A pressurisation pump is provided comprising a first plunger and a second plunger, each plunger being reciprocable within a respective plunger bore defined by a housing, wherein the first and second plungers together with the bores define, at least in part, a pumping volume. The pump also includes an inlet port and an outlet port. An end of the first plunger is arranged to cover the inlet port during a pump delivery stage in which fluid is displaced from the pumping volume and an end of the second plunger is arranged to cover the outlet port during a pump fill stage in which fuel is drawn into the pumping volume. The end of the first plunger and the end of the second plunger are arranged to cover the inlet port and the outlet port respectively during a pump transfer stage during which the pumping volume is maintained.

14 Claims, 10 Drawing Sheets

CAM-DRIVEN FLUID PUMP

BACKGROUND OF THE INVENTION

This invention relates to pressurisation pumps. In particular, this invention also relates to fuel pumps and especially, but not exclusively, to fuel pumps used with compression ignition internal combustion engines.

In all types of internal combustion engines it is important for fuel economy that as much of, if not all of, the fuel injected into a combustion chamber is consumed during each combustion cycle. As a first step towards that goal it is important that fuel injected into the combustion chamber is atomised as much as possible as this helps the combustion process by increasing the available fuel surface area for oxidation. Another important consideration is to ensure that the fuel is spread as homogeneously as possible throughout the combustion chamber as this aids flame propagation and so improves combustion efficiency. It follows then that for efficient operation the fuel needs to be injected as fast as possible to provide time to diffuse sufficiently before ignition and the fuel also needs to be injected under as high pressure as possible to ensure maximum atomisation. These factors are especially important for compression ignition engines, or diesel engines, as they rely on compressing air in the combustion chamber to high enough pressures so that the accompanying increase in temperature is hot enough to ignite diesel fuel injected into the combustion chamber, without using premixing or other techniques used in modern petrol engines to aid efficient combustion.

It is also important that the injection phase of each combustion cycle is controlled as tightly as possible to allow accurate fuel metering and ensure that the correct amount of fuel is injected to match engine load requirements, In known diesel engine systems fuel travels from a fuel pump to each individual cylinder of the engine in separate pipes. Fuel injection in the past has been handled by cam-driven injection systems, such as inline pumps, distributor pumps, unit injectors and unit pumps. These systems build up fuel injection pressure for each injection of fuel and are powered by the engine. Fuel metering and pressure build-up are therefore linked and cannot be separated. The injection pressure results from the metered fuel quantity being pushed through the injector nozzle orifice by an injection piston contained in the injector, and as the injection piston velocity is proportional to engine speed, so the resultant fuel pressure is also proportional to engine speed.

This link between engine speed and injection pressure in previous systems meant that only limited pressure is available at low engine speeds, harming fuel economy and delivering sluggish responsiveness, slow acceleration and a perception of unrefinement to the diesel automobile operator. In addition, in engines running at high speed there is reduced time on offer, compared to engines running at low speeds, for the air and fuel to mix sufficiently to allow complete combustion. It is clear that injection pressure is key to moving the combustion process along at the fast pace demanded by high-speed engines, and decoupling pressure generation from injection is also highly desired for the reasons explained above.

It was to address the above problems that common-rail diesel systems were developed. A typical common-rail system comprises a fuel supply pump, a common rail (or accumulator) and injectors all joined by high-pressure piping, an electronic control unit, and electronic driver unit and various sensors. The supply pump maintains high fuel pressure inside the rail and fuel is injected by opening and closing an internal electromagnetic valve in each injector. Hence, there is no relationship between engine speed and injection pressure. The common-rail system enables fuel to be injected into the engine's combustion chambers at very high pressures, so the fuel and air mix more thoroughly and burn more efficiently than previous systems. Additionally, as the fuel pump constantly replenishes the common rail with pressurised fuel, high pressure is maintained throughout the engine's range of speeds, thus solving the problem of hesitation on acceleration and improving refinement.

More recent inventions relating to common rail systems have been those of providing additional pressurisation in the unit injectors and direct fuel injection. However, with all these systems the common goal is to improve fuel economy, reduce emissions, reduce complexity and reduce the weight of the engine and dependent ancillaries.

Previous fuel pumps used with inline, distributor and common-rail systems used mechanically actuated valves to control input and output fuel from the fuel pump. Mechanical valving inevitably introduces losses through expenditure of energy in opening and closing inlet and outlet valves. Additionally, as these fuel pumps tend to be driven by the engine, utilising engine power to operate mechanical valving systems draws torque from the engine, resulting in less torque being available for useful work and hence, a further reduction in engine efficiency. Known fuel pumps have also tended to be complex and costly units—consequently there is a desire to reduce complexity as it brings obvious attendant advantages to both the manufacturer and consumer in terms of cost and reliability. With increasingly stringent emissions demands placed upon automobile manufacturers weight is also an important issue as weight has a direct effect on fuel consumption. All the desired improvements mentioned above are synergistic to improving efficiency. Furthermore, as the fuel pump in common-rail applications is running at high speed at all times during engine operation, even a small improvement in efficiency will produce appreciable gains over the long term.

SUMMARY OF THE INVENTION

It is with a view to providing a solution to the above problems and to maximise the benefits achievable by common-rail systems that we provide a pump for pumping fluid comprising a first plunger and a second plunger, each plunger being reciprocable within a respective plunger bore defined by a housing, the first and second plungers together comprising a first pair of plungers wherein the first and second plungers together with the bores define, at least in part, a pumping volume. The pump further comprises an inlet port and an outlet port wherein an end of the first plunger is arranged to cover the inlet port during a delivery stage in which fluid is displaced from the pumping volume, and wherein an end of the second plunger is arranged to cover the outlet port during a fill stage in which fuel is drawn into the pumping volume. The end of the first plunger and the end of the second plunger are arranged to cover the inlet port and outlet port respectively during a transfer stage during which the pumping volume is maintained.

It will be appreciated that the opposing faces of each plunger (i.e. the proximal ends) define the pumping volume together with the plunger bore. It will also be appreciated that any increase in volume due to relative movement between the first and second plungers when the inlet port is at least partially uncovered is reversed by further relative movement between the two plungers whilst the outlet port is at least partially uncovered.

Preferably, the first and second plungers are aligned along a common axis.

It is also preferred that the first and second plungers are driven by means of a single ring cam.

Alternatively, the first and second plungers may reside and be reciprocable within respective plunger bores that are in a parallel-spaced (side-by-side) relationship, wherein the plunger bores are in communication with one another by way of a connecting passage.

Advantageously, the first and second plungers are adapted to only partially cover the inlet and outlet ports respectively.

It is a preferred feature that the pump comprises two or more pairs of plungers, each pair of plungers performing, in use, a pumping cycle, and having respective inlet and outlet ports.

It is further advantageous that in the pumping cycle referred to above, a pumping cycle phase difference of between 115° to 130° exists between movement of the plungers of each plunger pair.

In the alternative, it is preferred that in the pumping cycle above a phase difference of 120° or 130° exists between movement of the plungers of each plunger pair.

In an alternative aspect of the invention, there is also provided a common rail fuel pressurisation system comprising a pump as described previously.

In a second aspect of the invention, there is provided a pump comprising a first and a second plunger within a housing, the first and second plungers together comprising a first pair of plungers, communicating means connecting the first and second plungers, an inlet port and an outlet port provided in the communicating means, a proximal end of the first plunger adapted to cover the inlet port, a proximal end of the second plunger adapted to cover the outlet port such that a volume is defined by the communicating means and the proximal ends of the first and second plungers, characterised in that the maximum volume defined while the inlet port is covered is greater than the maximum volume defined when the delivery port is covered.

In another aspect of the invention there is provided a pump for pumping fluid comprising two pairs of plungers, each pair of plungers performing, in use, a pumping cycle and comprising a first plunger and a second plunger and having a respective inlet and outlet port, each of the first plunger and the second plunger being reciprocable within a respective plunger bore defined by a housing, wherein the first plunger and the second plunger of each pair define, together with their respective bores, a pumping volume. An end of the first plunger of a pair is arranged to cover the inlet port during a pump delivery stage in which fluid is displaced from the pumping volume and an end of the second plunger of a pair is arranged to cover the outlet port during a pump fill stage in which fuel is drawn into the pumping volume and wherein the end of the first plunger and the end of the second plunger of a pair are arranged to cover the inlet port and outlet port respectively during a pump transfer stage during which the pumping volume is kept substantially constant.

DETAILED DESCRIPTION OF THE INVENTION

The present invention is now described with reference to the accompanying figures wherein.

Figure 9:
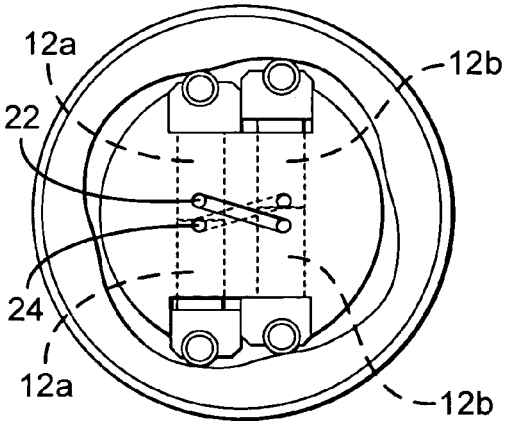
Figure 10:
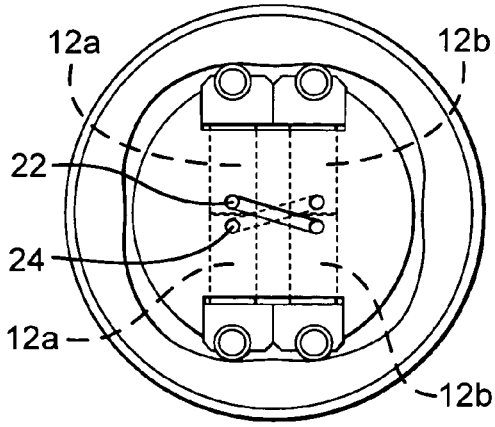
Figure 11:
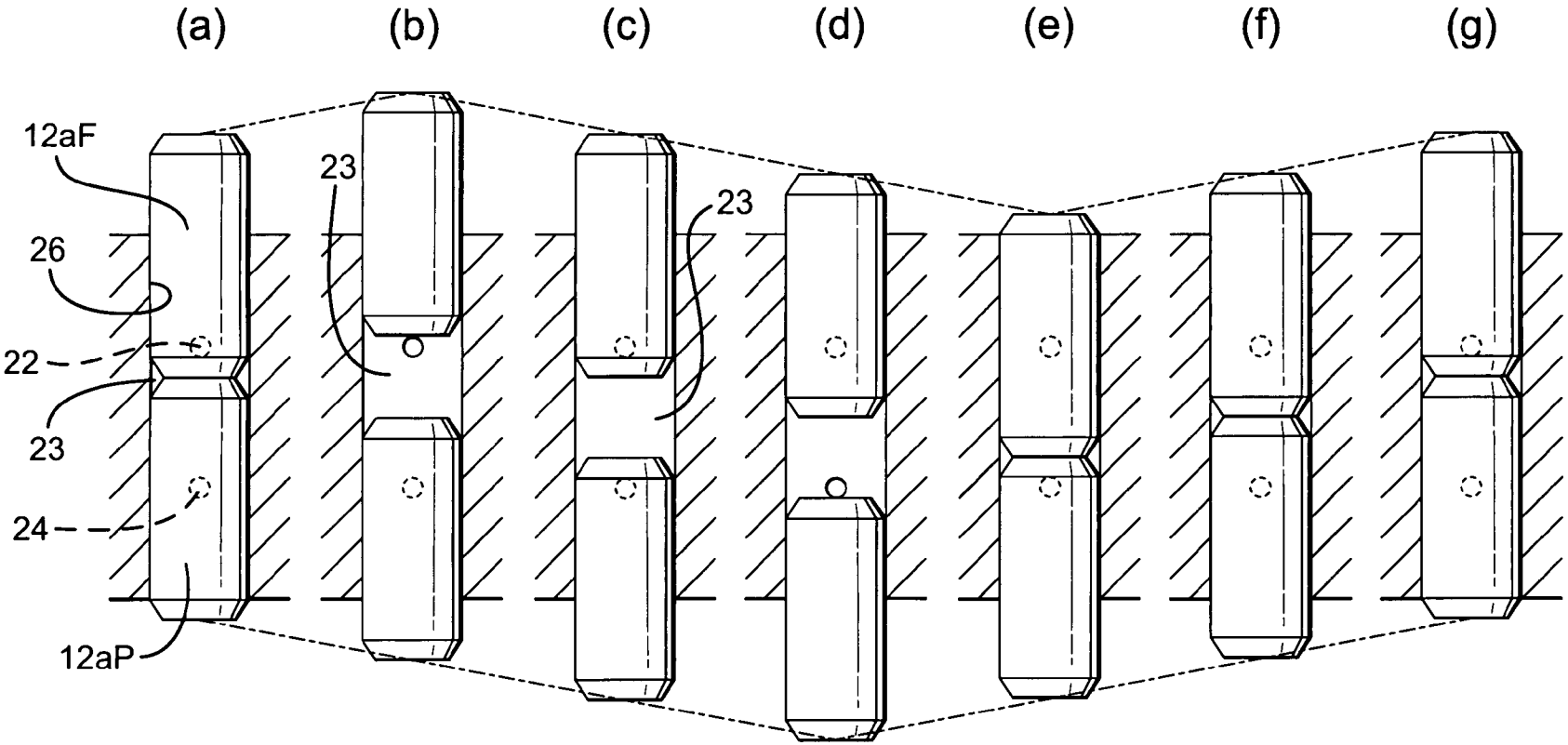
Figure 12:
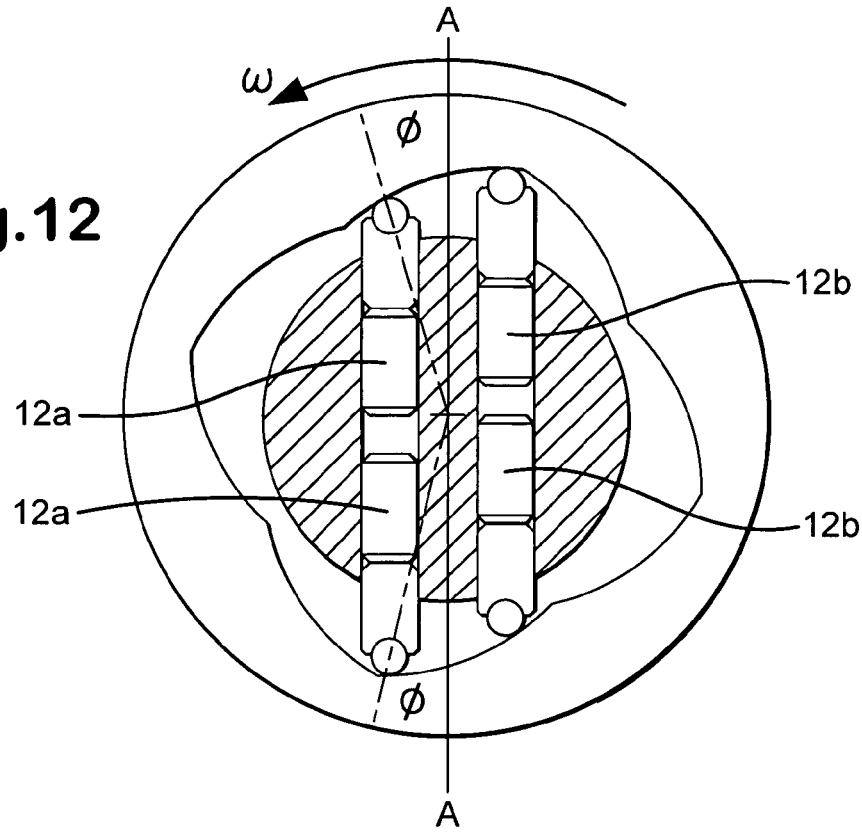
Figure 13:
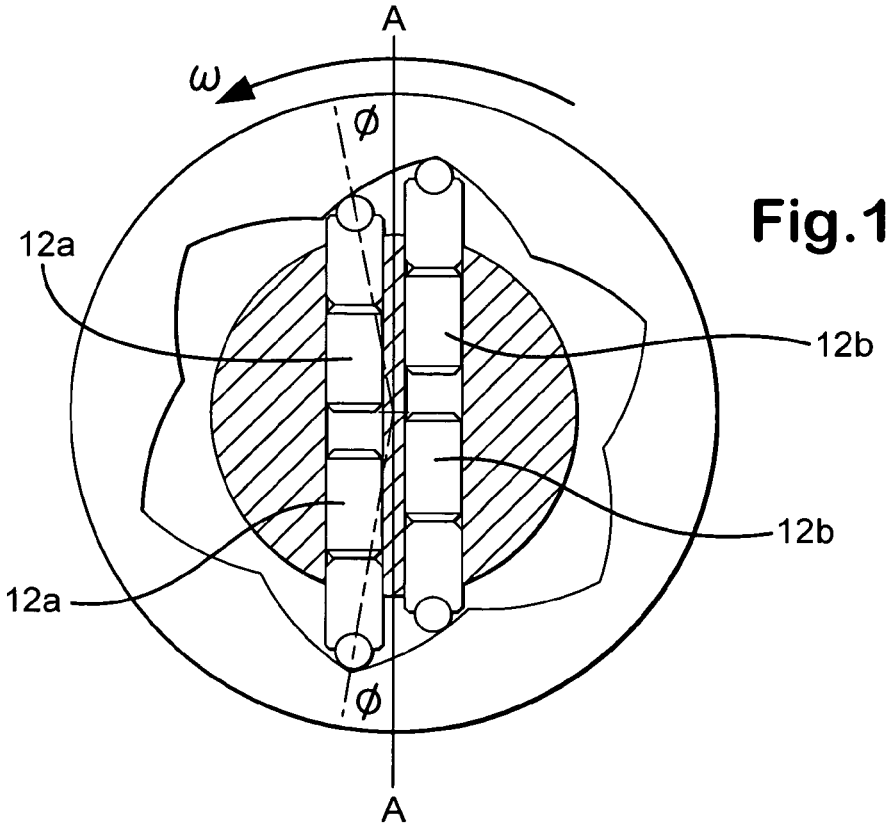
Figure 14:
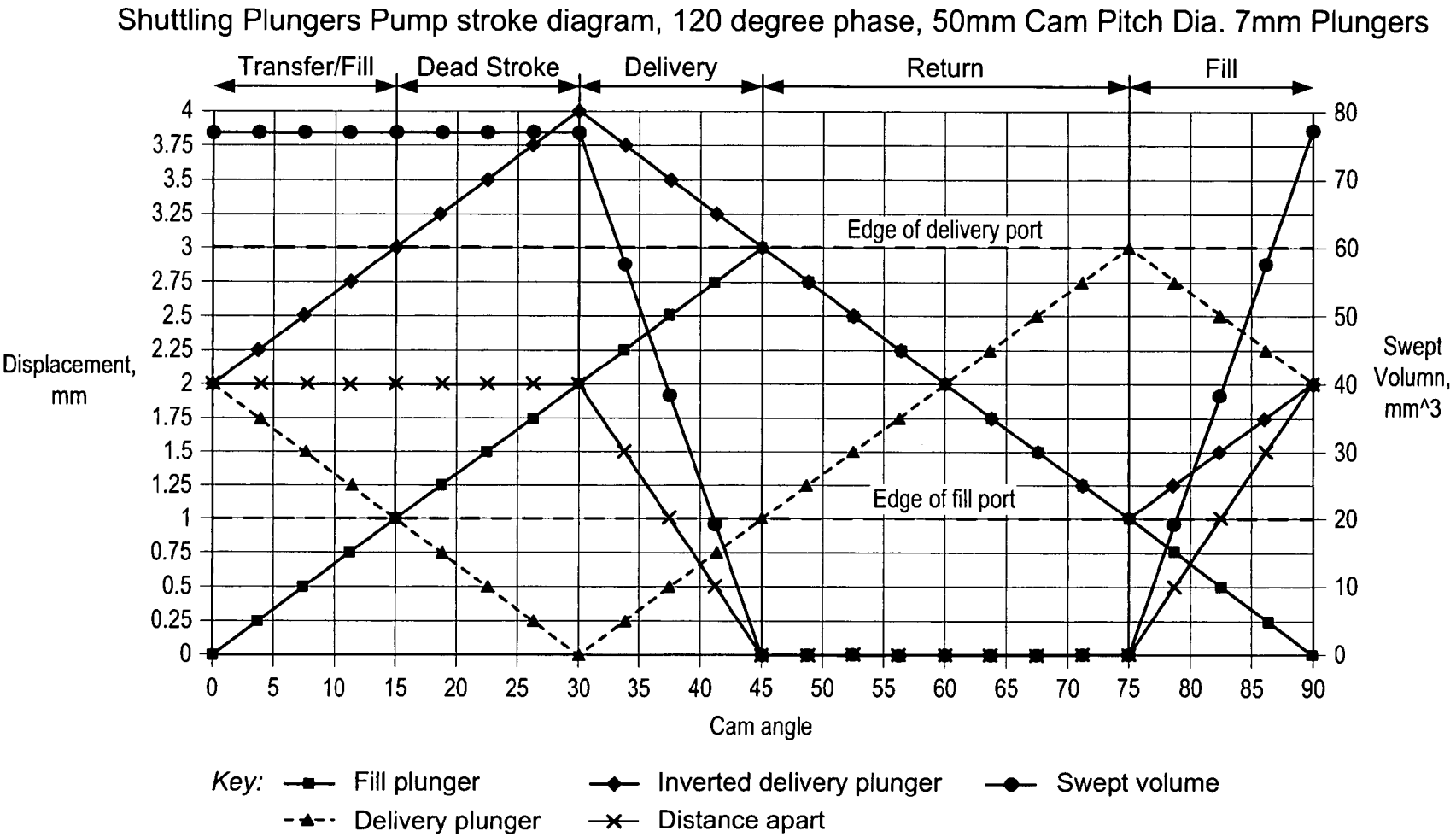
Figure 15:
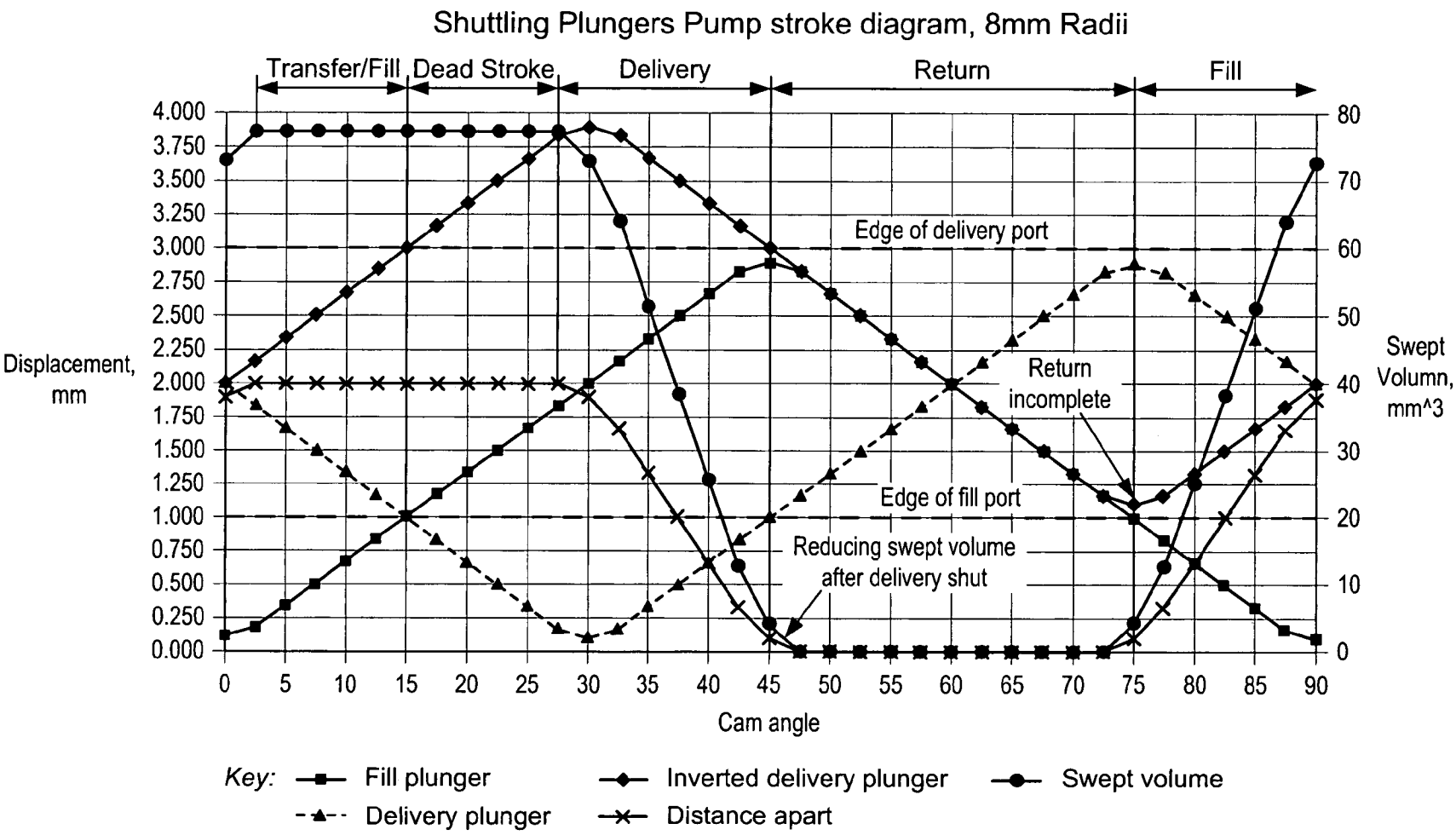
Figure 16:
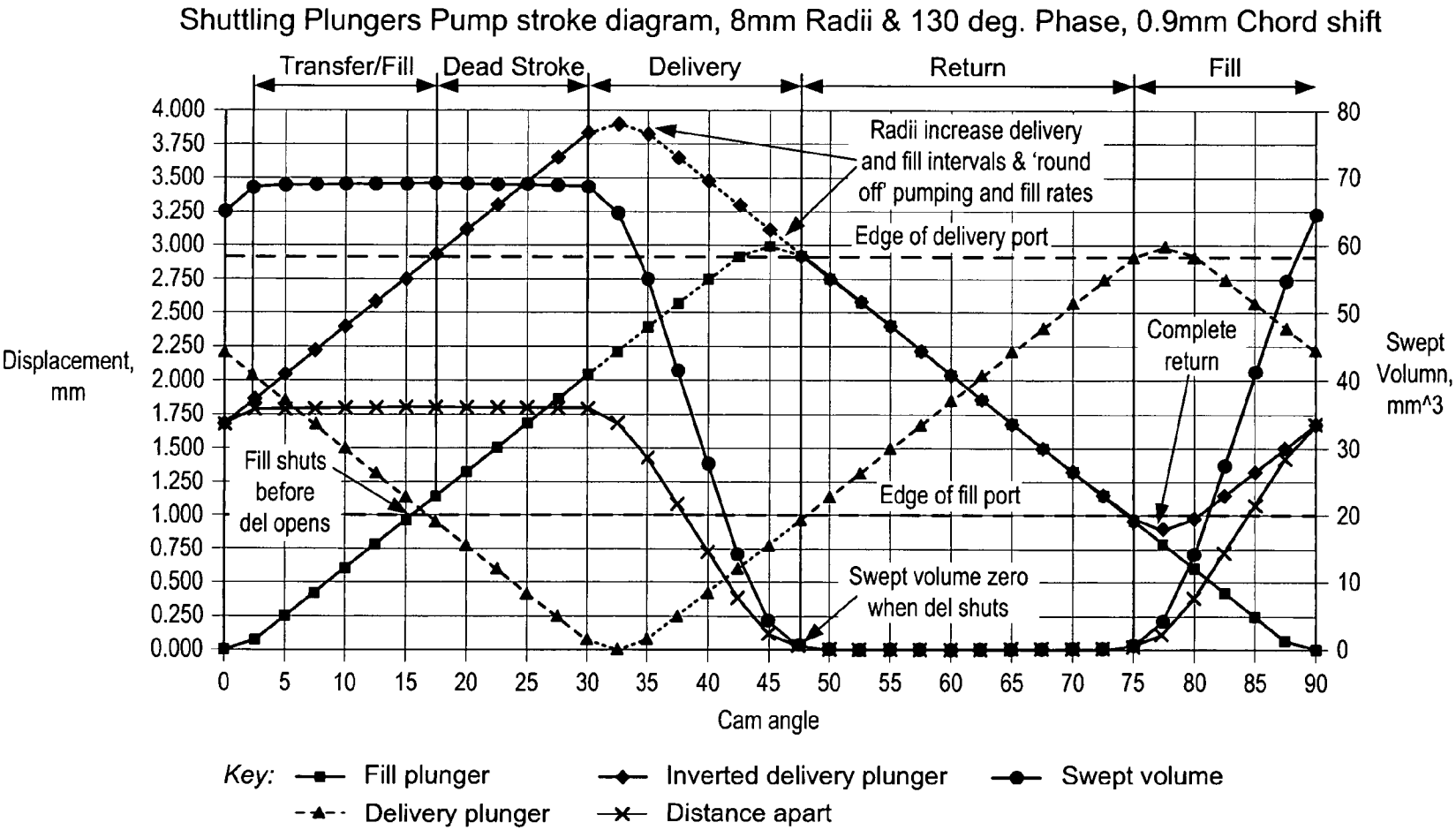
Figure 17:
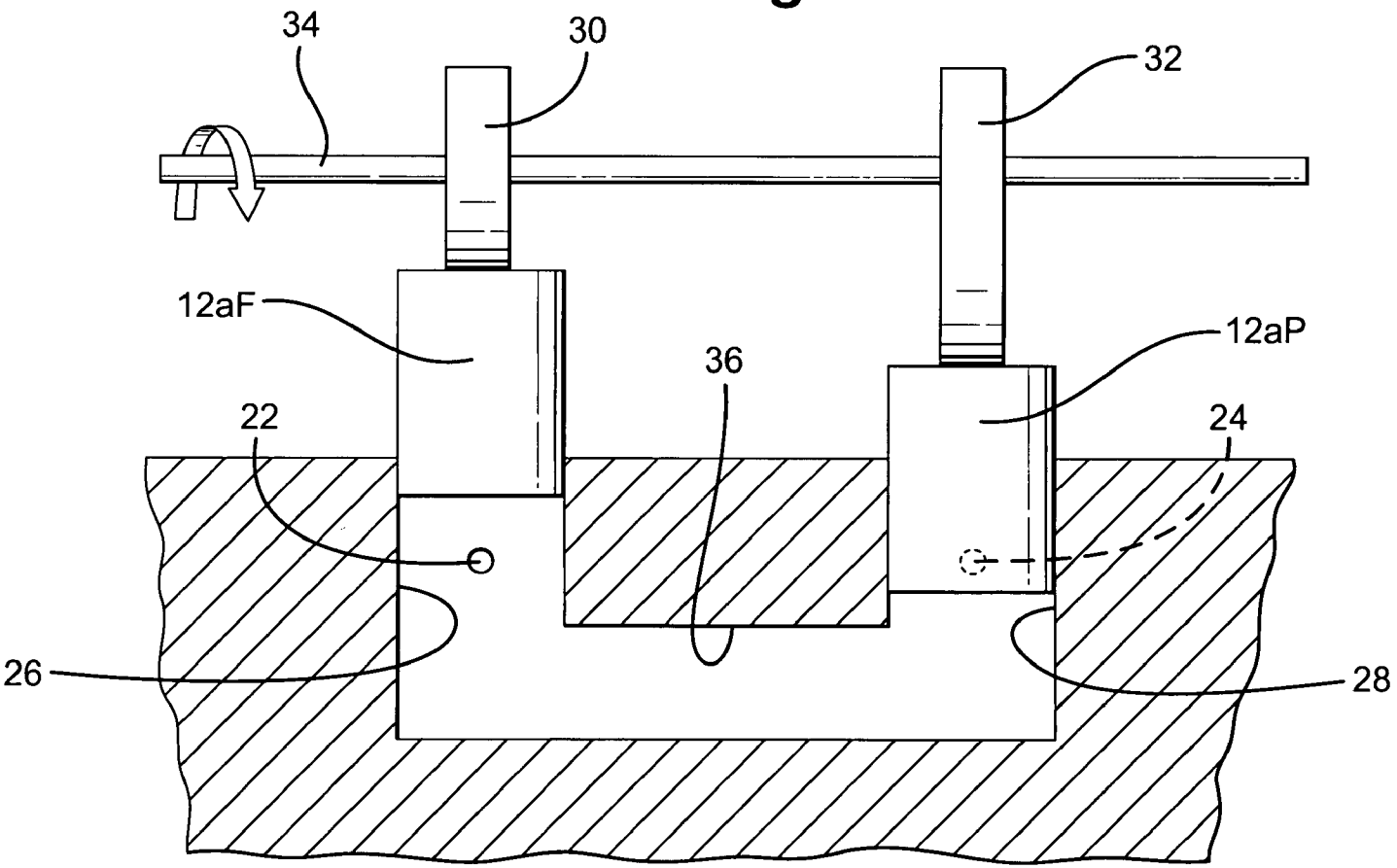

FIGS. 11(*a*) to 11(*g*) show in greater detail the positions of one set of opposed in-line plungers during the cycle shown in FIGS. 5 to 10;

FIGS. 12 and 13 show phase differences corresponding to 15° and 10° respectively between the two sets of opposed in-line plungers in FIGS. 2 to 10;

FIGS. 14 to 16 are projected mappings of displacement and swept volume during a pumping cycle for a pump according to the first embodiment, wherein FIG. 14 is for an idealised pump, FIG. 15 corresponds to projections for a pump with real-life characteristics and FIG. 16 corresponds to projections for a pump with optimised real-life characteristics; and FIG. 17 shows an alternative embodiment of the present invention wherein the two plungers are in a parallel-spaced relationship.

Figure 1:
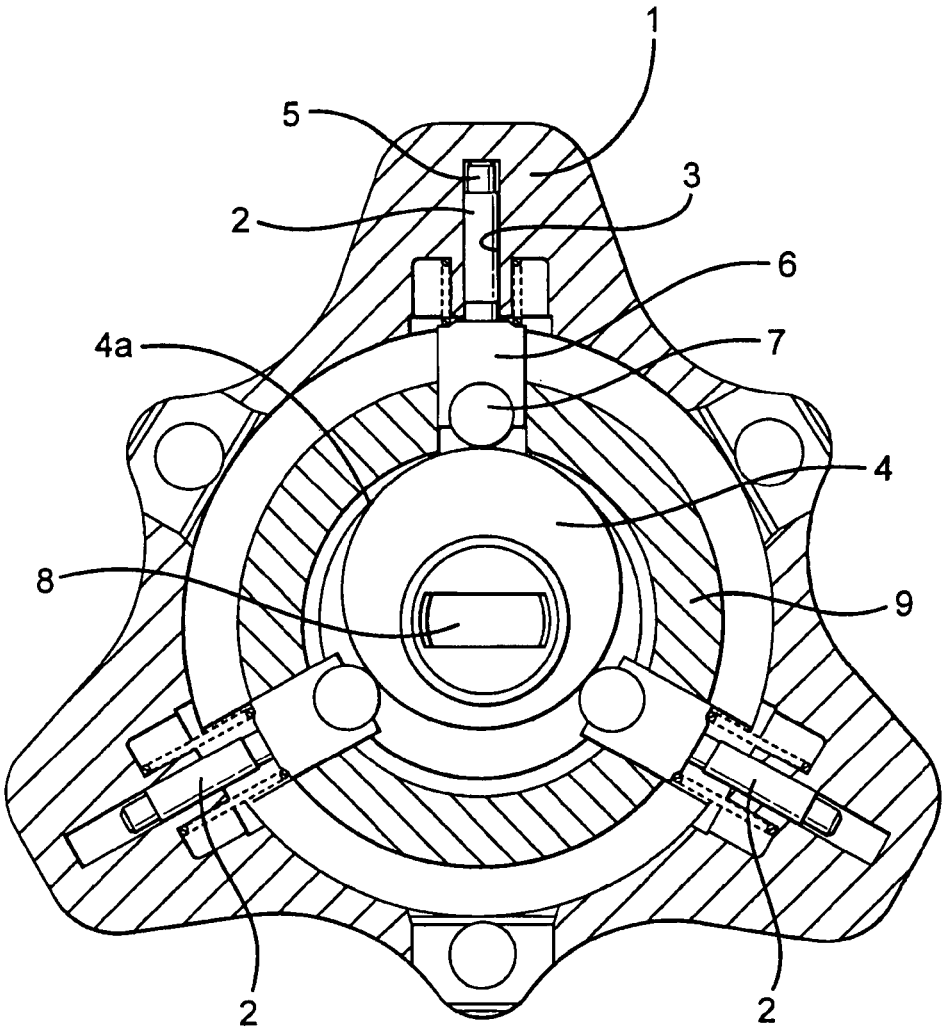
Fig.1 PRIOR ART
FIG. 1 is a schematic representation of a known compression ignition fuel pressurisation pump for delivering high pressure fuel to a plurality of injectors of a fuel system.

There is provided at FIG. 1 a schematic representation of a known type of pressurisation pump, which is the subject of a separate patent application, comprising a pump housing 1 and three radially mounted plunger members 2, each of which is reciprocable within a respective plunger bore 3 provided in the pump housing 1 under the influence of a respective drive arrangement 4, 6 and 7 so as to cause pressurisation of fuel within an associated pumping chamber 5. Each drive arrangement includes a cam 4 that is arranged to drive a reciprocable shoe 6 and a roller member 7, the cam being driven, in use, by means of an associated drive shaft 8. The roller member 7 is located radially inward of the shoe 6 and is cooperable with a cam surface 4*a* of the cam 4 so as to impart reciprocable movement to the shoe 6 upon rotation of the drive shaft 8. The pump also includes a tubular member 9 which is secured to the pump housing 1 and arranged such that it is substantially coaxial with the drive shaft 8, the tubular member 9 being further arranged such that it guides reciprocal movement of the shoe 6, in use. Although not shown in FIG. 1, this type of pressurisation pump requires separate mechanical valving means of the type commonly used with internal combustion engines to effect control over inlet and outlet of fuel.

Figure 2:
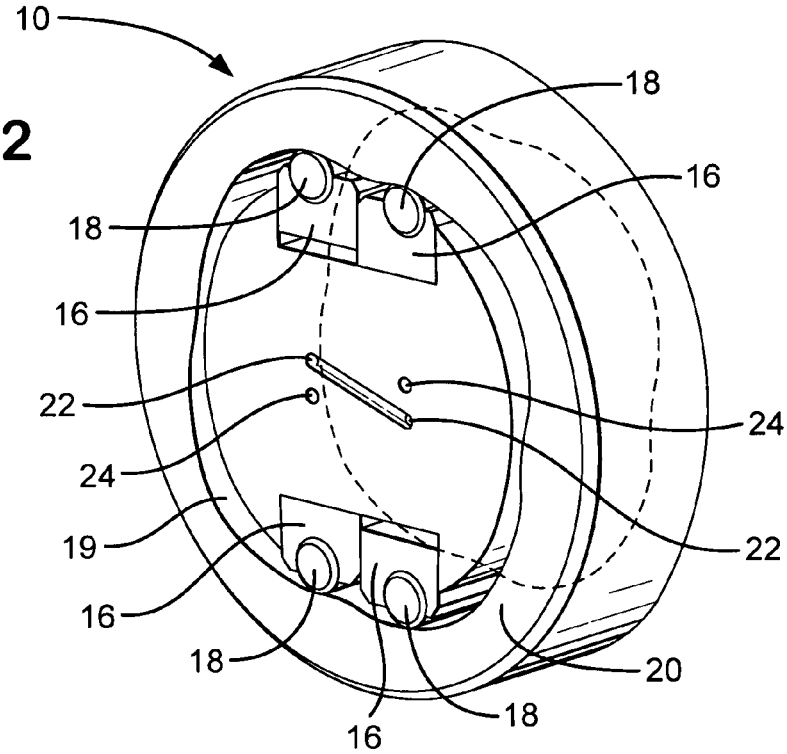
FIG. 2 is a representation of a pressurisation pump according to a first embodiment of the invention.
Figure 3:
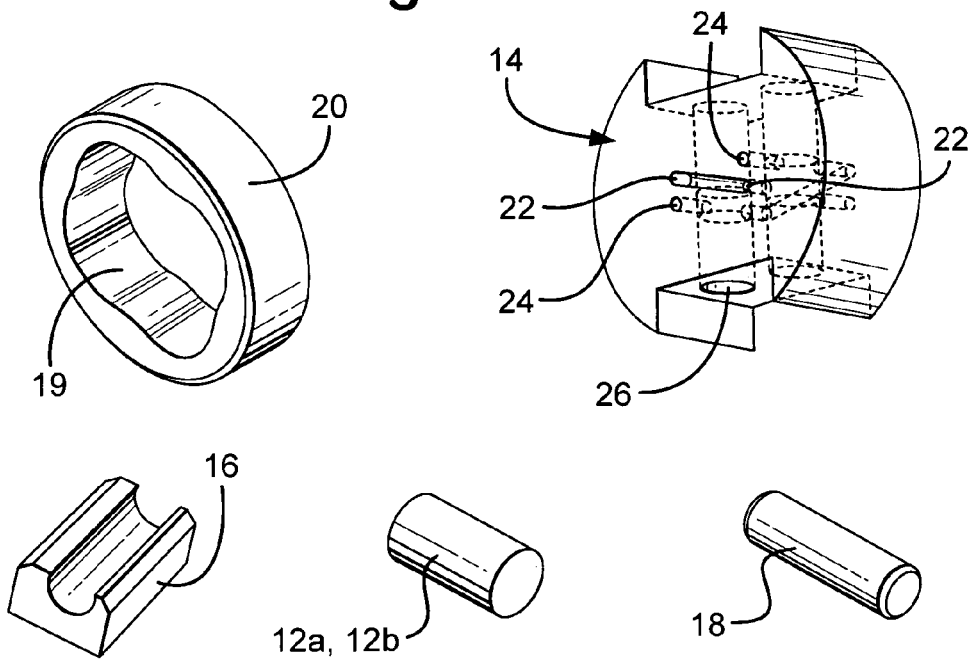
FIG. 3 shows the embodiment of FIG. 2 in exploded form showing principle components including two sets of opposed in-line plungers within a common bore.
Figure 4:
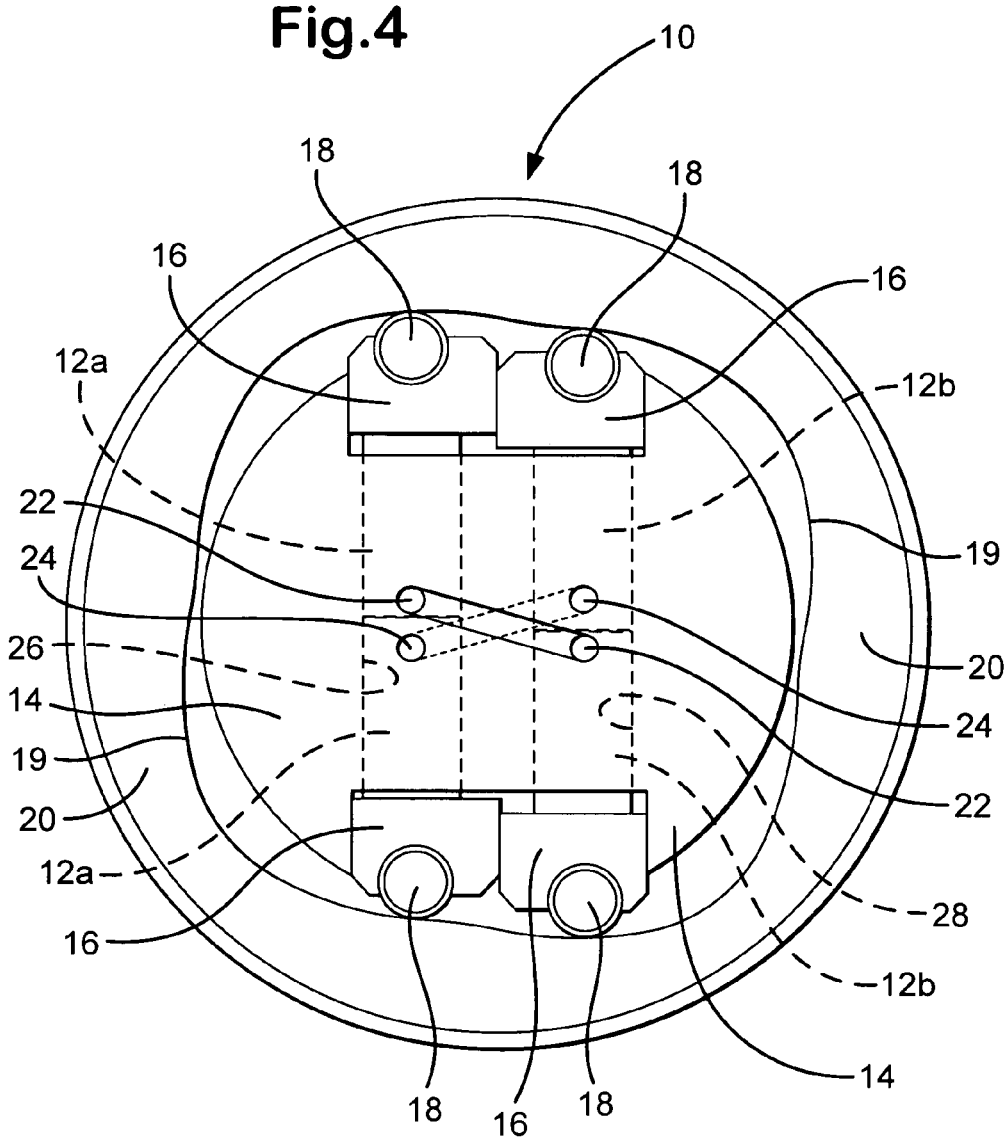
FIG. 4 shows a schematic view of the embodiment of FIGS. 2 and 3 taken at the start of a pumping cycle.

Turning to FIGS. 2 to 4, there is shown a representation of a pressurisation pump according to a first embodiment of the invention shown generally at 10. The pressurisation pump 10 comprises two pairs of plungers, a first pair of plungers 12*a* and a second pair of plungers 12*b*. The plunger pairs 12*a* and 12*b* are mounted in opposed in-line formation within a pump head 14. Each plunger approaches its paired plunger at its proximal end and at the distal end connects or is otherwise coupled to a shoe 16. Each shoe 16 embraces a respective roller 18, and the head, plungers, shoes and rollers are all mounted with respect to the head as shown such that only the rollers 18 are in contact with a cam surface 19 of a driven ring cam 20. The cam surface 19 is also known as the cam profile of the ring cam 20. Each pair of plungers resides and is moveable within a respective common bore 26, 28 provided in the pump head 14.

It will be appreciated that in the section shown in FIG. 2, the bores 26, 28 within which the plungers move are not visible, but can be seen clearly in FIG. 4.

Biasing means (not shown) may be employed to ensure that the plungers 12*a*, 12*b* are forced radially outwards so that the rollers 18 are in constant contact with the internal surface 19 of the ring cam 20 as it is driven, in use. Suitable biasing means may take the form of a resilient spring.

The internal surface 19 of the ring cam 20 is eccentrically shaped so that rotation of the cam 20 about its central axis, while the pump head 14 remains stationary, imparts a reciprocating motion to the plungers 12*a*, 12*b* and the shoes 16 through contact of the cam surface 19 with the rollers 18. This reciprocating motion can be quantized into pumping cycles. The ring cam 20 may be shaft-driven or driven by other means commonly employed to drive ancillary equipment relating to compression ignition engines.

In this embodiment the head 14 comprises four fill ports 22, two of which are located so as to communicate with one of the bores 26 and the other two of which are located so as to communicate with the other one of the bores 28. Fill ports 22 are also commonly referred to as inlet ports. Although not shown in FIGS. 2 to 4, the fill ports 22 are connected to the outlet of a transfer pump which supplies fuel to the inlet ports 22 at transfer pressure.

For each bore 26 and 28, each fill port 22 of one pair and each delivery port 24 of one pair is located diametrically opposite its paired port along the associated bore. Thus, in FIG. 2 only one fill port 22 and one delivery port 24 for each of the bores 26 and 28 is visible. The fill ports 22 allow fuel to be taken into the bore 26 and the delivery ports 24 allow fuel to be pumped out of the bore 26. It is preferred that pairs of fill and delivery ports are employed, and that each fill or delivery port is diametrically opposite the other port of the pair in its respective bore in order to balance forces generated during fill and delivery stages of the cycle, and so avoiding side-loading of the plungers. The delivery ports 24 are also commonly referred to as outlet ports or pumping ports.

In use, each of the plungers 12*a*, 12*b* is able to move within its bore 26, 28 so that all of the ports in that bore can be completely covered by a plunger, thus cutting off flow into or out of the bore 26,28 through that port. In the embodiment shown, one plunger of each plunger pair 12*a*, 12*b* is responsible for covering the inlet ports 22 and the other plunger out of the plunger pair 12*a*, 12*b* is responsible for covering the outlet ports 24.

FIG. 3 shows separately the components referred to in relation to FIG. 2 above. The bores 26 and 28 are seen in the head 14 in this view.

Figure 5:
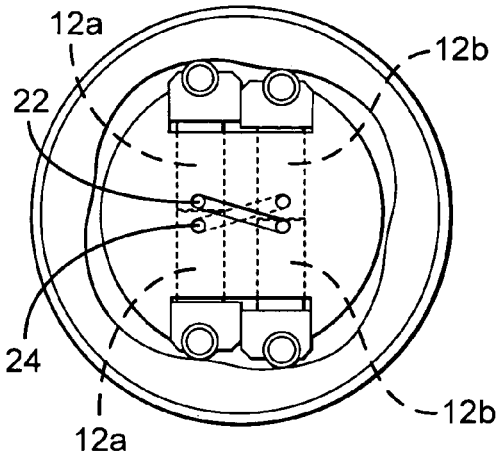
FIGS. 5 to 10 show the salient positions during one pumping cycle of the pressurisation pump shown in FIGS. 2 and 3.

FIGS. 5 to 10 show the salient positions of the plungers 12*a* and 12*b* during one pumping cycle of the pressurisation pump shown in FIGS. 2 and 3. The positions shown in FIGS. 5 to 10 appear in the order in which they occur in a pumping cycle. FIG. 5 is an exact reproduction of FIG. 4 but shown at a smaller scale. For the purpose of the following description, motion of only one of the plunger pairs 12*a* in the bore 26 will be described for clarity, although the other plunger pair 12*b* in the bore 28 operates in exactly the same manner.

Figure 6:
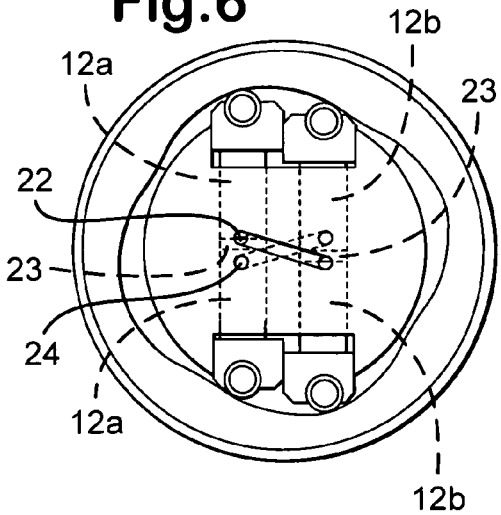
Figure 7:
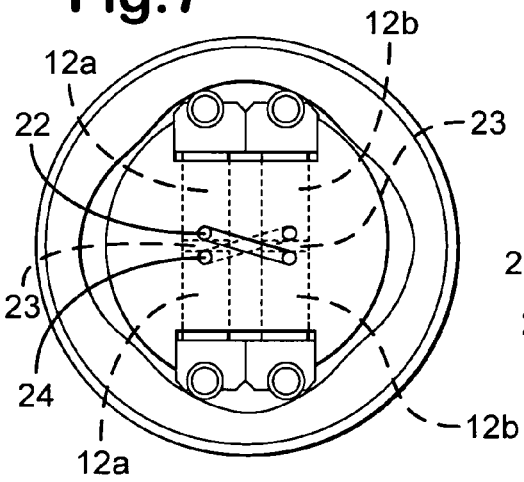
Figure 8:
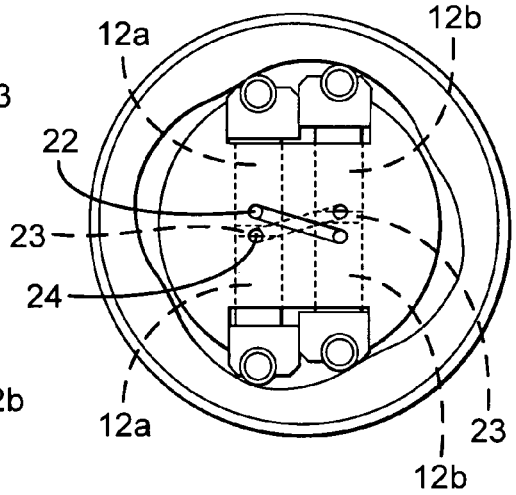

FIG. 5 shows the plunger positions when in a "start fill stage" of the pumping cycle during which the fill ports 22 becomes partially uncovered by one plunger of the pair, while the delivery ports 24 are covered by the other plunger of the pair. Relative movement between the two plungers 12*a* as the cam 20 rotates creates a volume 23 between the proximal ends of the plungers 12*a*—the volume 23 is not shown in FIG. 5 as this is the starting position of the cycle but is shown in FIGS. 6 to 8 instead. As the delivery ports 22 are covered the creation of the volume 23 results in fuel being drawn into the volume 23 through the fill ports 22.

The volume 23 is caused by ingress into the pumping bore 26 of fuel supplied by the transfer pump (not shown) at transfer pressure which forces the two plungers 12*a* apart. Accordingly in this embodiment there is no need for biasing means to force the two plungers 12*a* apart.

In FIG. 5 the starting position shows that there is no initial volume between the proximal faces of the two plungers 12*a*. It is envisaged in alternative embodiments that at the starting point of the pumping cycle there already exists a volume 23 between the plungers 12*a*. In this situation what is required in order to progress to the next stage is simply for an increase in volume to occur due to relative movement between the plungers 12*a*. Accordingly, in the situation where there is an initial volume between the plungers 12*a*, when the pumping cycle is complete and the plungers 12*a* return to the starting position the initial volume 23 between the plungers will be realised again.

FIG. 6 shows the plunger positions during the second stage of the pumping cycle, referred to as "the continue fill" stage. Fuel continues to flow into the bore 26 during the continue fill stage as the volume 23 increases to its maximum size as shown in FIG. 6. As the continue fill stage is completed the fill ports 22 become covered by one of the plungers of the pair. During the continue fill stage the delivery ports 24 stay fully covered.

FIG. 7 shows the plunger positions when in the third stage of the pumping cycle referred to as the "transfer ports" stage during which the fill ports 22 and the delivery ports 24 are all fully covered. Throughout this stage the size of the volume 23 is maintained at a substantially constant value due to the essentially incompressible nature of the fuel being transferred in the bore 26. Thus, both plungers move substantially in unison along the bores 26, 28.

In an alternative application, the fluid to be pumped can be compressible, for example a gaseous fuel/air mixture. In the example of pumping a compressible fluid, the volume 23 during the transfer ports stage can vary, perhaps providing additional compression to the delivery pressure that is achieved during the delivery phase.

FIG. 8 shows the plunger positions at the end of the transfer ports stage as the cycle moves into the "start delivery" stage. At the beginning of the start delivery stage the delivery ports 24 start to become uncovered while the fill ports 22 remain fully covered. The volume 23 diminishes as the plungers 12*a* of the pair start to move relative to one another, with relative movement between the two plungers 12*a* and the accompanying reduction in size of the volume 23 causing the fuel residing in the volume 23 to be ejected out of the bore 26 via the delivery ports 24.

FIG. 9 shows the position of the plungers once all the required fuel has been delivered from the bore, and this stage of the pumping cycle is known as the "end delivery" stage. This stage is arrived at following the start delivery stage by continued relative movement between the plungers 12*a*. The relative movement between the plungers 12*a* results in a decrease in size of the volume 23 and as the fill ports 22 are fully covered this causes the fuel residing in the volume 23 to be forced out of the bore 26 via the delivery ports 24 under high pressure. In the embodiment shown in FIG. 9, all the fuel transferred into the bore 26 during the transfer stage has been forced out of the bore by the time the end delivery stage is over.

FIG. 10 is the last stage in the cycle as both plungers 12*a* are moved in unison back to the start fill position again.

It will be appreciated that, during all stages of the pumping cycle, whether the plungers of each pair are moving relative to one another in an approaching or departing direction, or whether they are moving together, movement of the plungers 12*a*, 12*b* is caused by rotation of the cam 20 and the profile of the cam surface 19.

It will also be appreciated, bearing in mind the previous description of a prior art pressurisation pump, that in the embodiment described above there is an absence of separate mechanical valving means. Said valving means are not required as, in use, the motion of the plungers 12*a*, 12*b* to open and close the fill and delivery ports 22, 24 serves as controlling means to control the inlet and outlet of fuel into the pumping bore 26.

FIGS. 11(*a*) to 11(*g*) show in greater detail the positions of one set of opposed in-line plungers 12*a*, 12*b* relative to their respective fill and delivery ports 22, 24 during the cycle described in FIGS. 5 to 10 above.

FIG. 11(*a*) shows the pair of opposing in-line plungers 12*a*, further distinguished as comprising a fill plunger 12*a*F and a pumping plunger 12*a*P. In this schematic view only one each of the pairs of fill ports 22 and delivery ports 24 is shown, but the other side of the bore 26 (not shown) has a corresponding number of ports in mirrored locations. FIG. 11(*a*) shows the plungers 12*a*F and 12*a*P just prior to the start fill stage. It is to be noted that in FIG. 11(*a*) there exists an initial volume 23 at the start of the pumping cycle even though the plungers 12*a*F and 12*a*P are in contact with each other. This is due to the configuration of the plunger head chosen, wherein the heads comprise a tapered head that terminates at a shoulder.

As shown in FIG. 11(*b*), both plungers move in unison towards the fill ports 22 and once the fill ports are at least partially uncovered by the full plunger 12*a*F, relative movement between the two plungers 12*a*F and 12*a*P can occur which draws fuel into the bore 26 through the fill ports 22.

In FIG. 11(*c*), once the maximum volume 23 has been achieved the fill ports 22 are closed by further movement of the fill plunger 12*a*F which covers the fill ports 22 so that no further fuel can enter the bore 26. Transfer of the fuel to the delivery ports 24 now takes place. The maximum size of the volume 23 is determined by the cam profile 19 of the ring cam 20 (not shown in this view). It is noted that the maximum size of the volume 23 does not have to only be arrived at when the fill ports 22 are fully covered: the maximum volume size can be arrived at while the fill ports 22 are still at least partially uncovered.

Once the delivery ports 24 start to become uncovered by the pumping plunger 12*a*P, the fuel in the bore 26 starts to be pumped out of the bore 26 owing to relative movement between the two plungers 12*a*F and 12*a*P which decreases the volume 23 between them. FIG. 11(*d*) shows the pumping stage.

As shown in FIG. 11(*e*), further relative movement between the two plungers 12*a*F and 12*a*P ends when the volume 23 is decreased to a predetermined size and all of the fuel that is required to be pumped has been expelled from the bore 26. The minimum gap size (i.e. separation of the ends of a plunger pair) is also determined by the cam profile 19 of ring cam 20 (not shown). By virtue of the fact that the maximum gap size during fuel intake is larger than the minimum gap size during fuel delivery, a net positive pumping displacement of fuel out of the bore 26 is achieved.

Continuing the cycle, FIG. 11(*f*) shows the plunger 12*a*F returning toward the fill ports 22 in an opening direction and FIG. 11(*g*) shows the plungers 12*a*F, 12*a*P as they approach the edge of the fill ports 22, ready to restart the pumping cycle.

Plunger strokes can be achieved by a single cam profile 19 formed on the inside surface of the driven ring cam 20. When the axis of a plunger bore is angularly offset from the major axis A (shown in FIGS. 12 and 13) of the cam 20 by an angle $\phi$, a phase difference between movement of the plungers of each pair 12*a*, 12*b* of plungers is generated. FIGS. 12 and 13 show phase differences between the two sets of opposing in-line plungers 12*a* and 12*b* corresponding to $\phi$ values of 15 degrees and 10 degrees respectively. The direction of rotation of the driven ring cam 20 is shown by the arrow 107.

Referring to FIGS. 12 and 13, for 120 degrees cyclical phase difference between the two plungers of each pair 12*a* and 12*b*, a four lobe cam (FIG. 12) requires the plungers 12*a*, 12*b* to have a phase difference of 30 degrees—i.e. the centre line of the bores 26 and 28 are each 15 degrees off-set ($\phi$=15°) from the centre line of the cam 20. For a six lobe cam operating plungers with 120 degrees cyclical phase difference (FIG. 13) the plungers need to be 20 degrees out of phase in total—i.e. each bore centreline is 10 degrees offset from the cam centre line ($\phi$=10°).

To double the pump output another pair of plungers can be run on the reverse side of pump 10 driven by the same or a different cam. The modular nature of the invention means that further pump units can be arranged together in series, axially spaced along a cam drive shaft, to form a compact unit to provide the desired output of pressurised fuel. The pump therefore provides a much smaller and simpler arrangement than previously available. The addition of further pumping units has the further advantage of smoothing and refining the resulting operation of all the pumps so connected.

FIG. 14 shows the projected displacement and swept volume data during a pumping stroke for an idealised pressurisation pump according to FIGS. 2 to 13, assuming zero plunger inertia and idealised 'triangular' movement plots.

FIG. 15 highlights possible problems with plungers 12*a*, 12*b* having a nose radius of 8 mm in a 120 degree off-set configuration, and FIG. 16 shows how such problems may be solved by moving to a 130 degree off-set configuration with a reduced distance between the fill and delivery ports.

FIG. 17 shows an alternative embodiment of the present invention which differs to previous embodiment of the invention in that the first and second plungers 12*a*F, 12*a*P reside and are reciprocable within parallel-spaced first and second plunger bores 26, 28, rather than in-line. The plungers 12*a*F, 12*a*P are therefore side-by-side, in a parallel-spaced relationship. The first and second plunger bores 26, 28 are connected by way of a communicating means in the form of a connecting passage 36. In a manner similar to the embodiment shown in FIGS. 2 to 16, there are a pair of fill ports 22 and a pair of delivery ports 24 arranged along the passage 36 with each fill port 22 diametrically opposite its paired port across the passage 36. In FIG. 17 only one port of each pair of ports 22, 24 is shown. The plungers 12*a*F and 12*a*P are biased by resilient means (not shown) towards the direction of cam lobes 30 and 32 and which are connected to a common camshaft 34. Rotation of the camshaft 34 and the cam lobes 30, 32 reciprocates the plungers 12*a*F and 12*a*P within their respective bores 26, 28 so as to cause the plungers 12*a*F and 12*a*P to cover and uncover the fill and delivery ports 22 and 24 in a phased manner as has been described with reference to FIGS. 14 to 16. Therefore, a net pumping of fuel is achieved with each pumping stroke. The stages of each pumping stroke in this embodiment are the same as those for the embodiment described in FIGS. 2 to 16.

It will be understood that various modifications to the aforedescribed embodiments may be made without departing from the scope of the invention as defined by the claims. For example, although the present invention has been illustrated in the context of a fuel pressurisation pump, the same concept works with any fluid which requires pressurised delivery in applications wherein space, weight and mechanical complexity are desired to be kept to a minimum. Additionally, although reference is made throughout to inlet and delivery ports, this should be taken to encompass inlet and delivery slots. The provision of the slots in the bore may be advantageous. Furthermore it is to be understood that although the present invention utilises pressurised fuel supplied by a transfer pump to create and enlarge the volume 23 between the plungers 12, 12*a* and 12*b*, the invention is not dependent on this feature.

As mentioned previously and purely as an example of the alternative methods available, it is envisaged that biasing means in the form of a resilient spring may be employed within the bore 26 between the facing ends of the plungers 12, 12*a* and 12*b* to enlarge the volume 23 so that fuel may be admitted into the bore 26. It is further envisaged that it may be advantageous to employ a combination of these features. Accordingly, it is to be understood that the invention is not to be limited to the specific illustrated embodiment, but only by the scope of the appended claims.

The invention claimed is:

1. A pump for pumping fluid comprising:

a ring cam having a central axis, configured to rotate about an axis of rotation coincident with the central axis, and surrounding a pump head having a major axis, said pump head defining two parallel plunger boars extending therethrough, said plunger boars arranged on opposing sides of the major axis, separated from the major axis by an offset, each having the same off-set from the major axis, and having a common bore axis plane substantially transverse to the central axis, each plunger boar having a pair of plungers, each pair of plungers comprising a first plunger and a second plunger, each plunger being reciprocable within a respective plunger bore defined by a housing, the respective plunger bores being in communication with one another by way of a connecting passage, wherein each pair of first and second plungers, together with their respective plunger bores, defines, at least in part, a pumping volume, each pair of plungers performing, in use, a pumping cycle, and each pair of plungers having a respective inlet port and outlet port, wherein an end of each said first plunger is arranged to cover its respective inlet port during a pump delivery stage in which fluid is displaced from the pumping volume, wherein an end of each said second plunger is arranged to cover its respective outlet port during a pump fill stage in which fuel is drawn into the pumping volume, wherein the end of each said first plunger and the end of each said second plunger are arranged to cover the inlet port and outlet port respectively during a pump transfer stage during which the pumping volume is maintained, wherein each pair of first and second plungers are aligned along a respective common bore axis, and each said pair of first and second plungers mounted in opposed in-line formation within said pump head, and wherein each plunger is coupled to a shoe that embraces a respective roller that is in contact with, and is thus driven by the ring cam.

2. A pump according to claim 1, wherein the first and second plungers are adapted to only partially cover the inlet and outlet ports respectively.

3. A pump according to claim 1 wherein a pumping cycle phase difference of 115° to 130° exists between movement of the plungers of each plunger pair.

4. A pump according to claim 1 wherein a pumping cycle phase difference of 120° exists between movement of the plungers of each plunger pair.

5. A pump according to claim 1 wherein a pumping cycle phase difference of 130° exists between movement of the plungers of each plunger pair.

6. A pump for pumping fluid comprising:

a ring cam having a central axis, configured to rotate about an axis of rotation coincident with the central axis, and surrounding a pump head having a major axis, said pump head defining two parallel plunger boars extending therethrough, said plunger boars arranged on opposite sides of the major axis and separated from the major axis by an offset, each having the same off-set from the major axis and having a common bore axis plane substantially transverse to the central axis, each plunger boar having a pair of plungers, each pair of plungers performing, in use, a pumping cycle and comprising a first plunger and a second plunger and having a respective inlet and outlet port, each of the first plunger and the second plunger being reciprocable within a respective plunger bore;

wherein the first plunger and the second plunger of each pair define, together with their respective bores, a pumping volume;

an end of the first plunger of a pair is arranged to cover the inlet port during a pump delivery stage in which fluid is displaced from the pumping volume;

an end of the second plunger of a pair is arranged to cover the outlet port during a pump fill stage in which fuel is drawn into the pumping volume;

wherein the end of the first plunger and the end of the second plunger of a pair are arranged to cover the inlet port and outlet port respectively during a pump transfer stage during which the pumping volume is kept substantially constant;

wherein each said pair of plungers is mounted in opposed in-line formation within said pump head, and wherein each plunger is coupled to a shoe that embraces a respective roller that is in contact with, and is thus driven by the ring cam.

7. A pump according to claim 1, wherein each said inlet port is connected to the outlet of a transfer pump.

8. A pump according to claim 1, wherein each said outlet port is connected to a common rail fuel delivery system of an internal combustion engine.

9. A pump according to claim 1, further comprising biasing means configured and positioned so as to urge said plungers in a radially outward direction so as to maintain said rollers in substantially constant contact with said cam ring as said cam ring rotates about said axis of rotation.

10. A pump according to claim 9, said biasing means comprising a resilient member.

11. A pump according to claim 9, said biasing means comprising a volume of fluid positioned within said respective plunger bores, said fluid being pressurized so as to urge said plungers in a radially outward direction relative to said axis of rotation.

12. A pump according to claim 1, wherein said housing remains stationary while said cam ring rotates about said axis of rotation so as to impart reciprocating motion to said plungers.

13. A pump according to claim 1, wherein said inlet port and said outlet port are positioned diametrically opposite one another along a respective bore so as to balance forces during said pump fill and delivery stages.

14. A multi-stage fluid pump comprising a plurality of pumps according to claim 1, said plurality of pumps being arranged in series and thus axially spaced along said axis of rotation.

* * * * *